US006551189B1

(12) United States Patent
Chen et al.

(10) Patent No.: US 6,551,189 B1
(45) Date of Patent: Apr. 22, 2003

(54) SIMULATED LASER SHOOTING SYSTEM

(75) Inventors: Shaoyuan Chen, Beijing (CN); Yue Zhang, Beijing (CN)

(73) Assignee: Beijing Kangti Recreation Equipment Center, Beijing (CN)

( * ) Notice: Subject to any disclaimer, the term of this patent is extended or adjusted under 35 U.S.C. 154(b) by 0 days.

(21) Appl. No.: 09/890,591

(22) PCT Filed: Dec. 23, 1999

(86) PCT No.: PCT/CN99/00216

§ 371 (c)(1),
(2), (4) Date: Aug. 3, 2001

(87) PCT Pub. No.: WO01/39852

PCT Pub. Date: Jun. 7, 2001

(30) Foreign Application Priority Data

Dec. 3, 1999 (CN) ..... 99125542

(51) Int. Cl.[7] ..... A63B 67/00; A63B 9/02
(52) U.S. Cl. ..... 463/49; 463/51; 463/53
(58) Field of Search ..... 463/49, 51, 52, 463/53; 273/359; 434/11

(56) References Cited

U.S. PATENT DOCUMENTS

| | | | | |
|---|---|---|---|---|
| 5,366,229 | A | 11/1994 | Suzuki | |
| 5,738,522 | A * | 4/1998 | Sussholz et al. | 434/22 |
| 6,256,047 | B1 * | 7/2001 | Isobe et al. | 345/473 |
| 2002/0010021 | A1 * | 1/2002 | McCauley | 463/37 |
| 2002/0107069 | A1 * | 8/2002 | Ishino | 463/30 |

FOREIGN PATENT DOCUMENTS

| | | |
|---|---|---|
| JP | 8-276076 | 10/1996 |

* cited by examiner

*Primary Examiner*—Denise L. Esquivel
*Assistant Examiner*—Marc Norman
(74) *Attorney, Agent, or Firm*—Collard & Roe, P.C.

(57) ABSTRACT

The invention provides a simulated laser shooting system that includes a laser gun, HD monitor, video camera, collection card, master computer and sound apparatus. The system's features are in that it has reality scene, is both dynamic and static, and is rich and colorful. Players can fight an on-line battle by the system.

2 Claims, 2 Drawing Sheets

SIMULATED LASER SHOOTING SYSTEM

CROSS REFERENCE TO RELATED APPLICATIONS

Applicants claim priority under 35 U.S.C. §119 of Chinese Application No. 99 1 25554.2 filed Dec. 3, 1999. Applicants also claim priority under 35 U.S.C. §120 of PCT/CN99/00216 filed Dec. 23, 1999. The international application under PCT article 21(2) was not published in English.

TECHNICAL FIELD

The invention provides a simulated laser shooting system that belongs to games and entertainment field.

BACKGROUND ART

At present, the simulated laser shooting system usually consists of laser gun and target, and usually the target is a static picture, whose contents are simplistic, uninteresting and lack of attraction.

The invention is used for providing a dynamic picture displaying, and the picture can be updated automatically after the target in the original picture was shot.

DISCLOSURE OF THE INVENTION

The said new simulated laser shooting system is completed according to the following technical schemes:

A kind of simulated laser shooting system includes a laser gun, HD monitor, video camera, collection card, master computer and sound apparatus. And the master computer has the soft system for measuring laser beam point and soft system for master control. The master computer will control the sound apparatus and control the HD monitor by the soft system for master control. The soft system for measuring laser beam point is composed by video camera, collection card and laser spots measuring software system, the said video camera is placed at the place where the camera can shoot the high-definition pictures, its outlet must be connected with the inlet of collection card, the outlet of collection card must be connected with the soft system for measuring laser beam point in the master computer, and soft system for measuring laser beam point must be connected with the soft system for master control, the soft system for master control can perform the following steps:

firstly, the new animation frame must be generated when the target is not shot, and then collect the picture signals processed by the soft system for measuring laser beam point. Detecting whether there are laser beam points in the picture (yes/no), if no, return to the new step of the animation frame when the target is not shot. If yes, then detect whether the laser beam point has shot the target (yes/no), if no, then return to the new step of the animation frame when the target is not shot and score the game. If yes, then switch to new animation when the target is shot and score the game. As the improvement of this invention, you can connect this master computer with the other simulated laser shooting systems by Internet.

The working principle of this system is shown as followings:

The HD monitor can display the pictures according to the input signals controlled by the soft system for the master control, at the same time, the sound apparatus will play the sound controlled by the master computer, the video camera can shoot the optical signals displayed by the HD monitor and converted into electric signals and transmitted this signals to the collection card, the collection card will convert the collected electric signals into digital signals stored by frames and then transferred to master computer, this signals can be processed by the soft system for measuring laser beam point in the master computer, then the input signals can be converted into the signals which can be identified, processed and detected by the soft system for master control. The soft system for master control will operate according to the preset program and detect whether there are laser beam points in the picture or whether there are target shot by the laser beam points and then determine the displayed picture and score of the game on the HD monitor.

Because this technical scheme can display dynamic pictures, play the sound and automatically update the pictures after the targets were shot. So the system's features are in that it has reality and vivid scene, clear and natural, if connected with the Internet, the players can fight an on-line battle and rank the order of the game.

BRIEF DESCRIPTION OF THE INVENTION

Combined with the attached figures and embodiments, we make further description about the invention.

Figure 1:
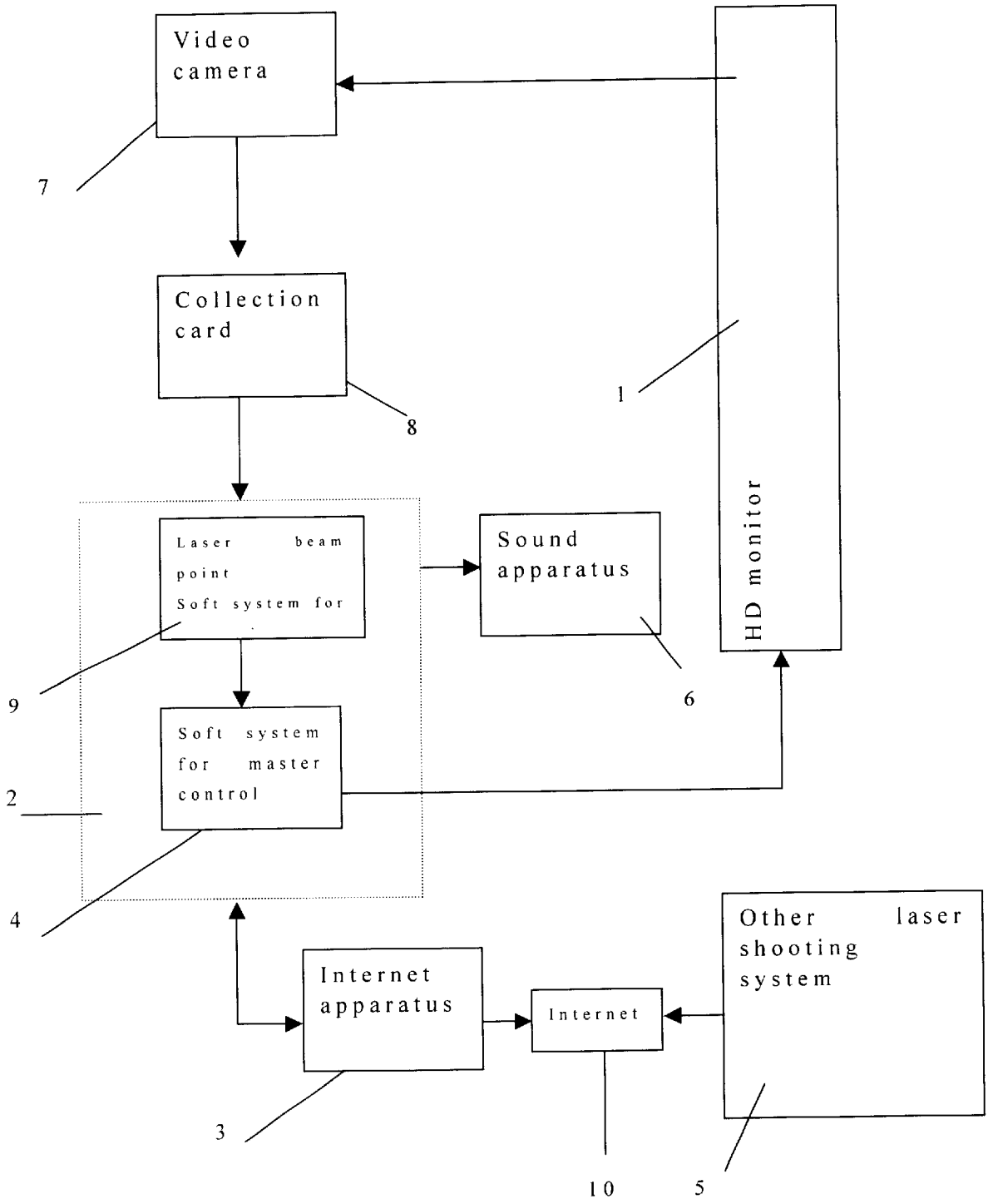
FIG. 1 is the system figure of this invention.

In this embodiment, the Internet system structure of the simulated laser shooting system is provided, it includes a laser gun (not shown in this figure), HD monitor 1, video camera 7, collection card 8, master computer 2 and sound apparatus 6. And the master computer 2 has the soft system for measuring laser beam point 9 and soft system for master control 4. The master computer 2 will control the sound apparatus 6 and control the HD monitor 1 by the soft system for master control 4. The soft system for measuring laser beam point is composed by video camera 7, collection card 8 and laser spots measuring software system 9, the said video camera 7 is placed at the place where the camera can shoot the high-definition pictures, its outlet must be connected with the inlet of collection card 8, the outlet of collection card 8 must be connected with the soft system for measuring laser beam point 9 in the master computer 2, and soft system for measuring laser beam point 9 must be connected with the soft system for master control 4, the master computer 2 can be connected with the Internet 4 by the Internet apparatus 3, the Internet 4 can be connected with the other simulated laser shooting system 5.

In this embodiment, the HD monitor 1 is used for display the pictures created by the computer, at the same time, these pictures are used for the target of the laser gun. The laser gun 2 is used for shooting the laser to the HD monitor 1, the soft system for measuring laser beam point is used for measuring the coordinates of the laser beam points on the screen, and the video camera 7 is used to convert the optical signals from the pictures of the screen and laser beam points into electric signals, the collection card 8 is used to convert the electric signals from the video camera into digital signals stored by frame and determine the grey values of every pixels in one picture. The soft system for measuring the laser beam points 9 is used to find the point with the maximum grey value and determine whether it is the laser beam point (yes/no), if yes, this system will calculate the coordinates in the screen, the soft system of master control 4 is used to create the dynamic pictures and control the playing of the sound apparatus, and compare the coordinates of the laser beam points from the soft system for measuring the laser beam points with the coordinates of the target, detecting whether the target is shot (yes/no), if yes, then the system will switch to the dynamic pictures such as fell over of the animal, fire or explosion of aircrafts, warships and so on. At the same time, the scoring of the game and ranking the order can be performed and the players can fight an on-line battle by controlling the Internet apparatus. The sound apparatus 5 is controlled by the soft system for master control to play the sound such as gunshots, sounds of each animals, buzz of the aircrafts etc, the Internet apparatus 3 is used for connecting many a simulated laser shooting systems to let the players can fight an on-line battle.

The working principle of the soft system for measuring the laser beam points is shown as following:

Shooting the figures and laser beam points on the screen with the video camera, because the brightness of the laser beam points are more greater than the other picture, when the iris of the video camera is zoomed in enough, then the pictures collected by the video camera are only those pictures with the laser beam points which grey values are larger than a constant value a ($0<a<256$, usually $a=230$), and the grey values of the other points are lesser than a, thus the pixel of the laser beam point can be distinguished from the other points according to the detecting of the grey values by the soft system for measuring the laser beam point, at this time, the coordination of the pixel of the laser beam point at the frame collected by the collection card can be obtained, and then the coordinate of this laser beam point on the screen can be calculated by conversion.

In the soft system for measuring the laser beam point, we can obtain the grey values of each pixel of current frame by calling the functions in the collection card, and then find the point with the maximum grey value by cyclic diagnosis algorithm to determine whether the grey value is more than one constant value a (for example 230) (yes/no), if yes, then indicate that the pixel related with this maximum grey value is the pixel of laser beam point, not the projection of the other beam on the screen (because the grey value of other pixel related with the other beams on the screen can't be more than the constant value a). At this time you can simultaneously obtain the coordinate of this pixel on the picture shot by video camera, and gain the coordinate on the screen by the other conversion. The conversion factor is obtained by the calibration of the soft system for measuring the laser beam point before using it, when the calibration is completed, and the location of the video camera is unchanged, then the conversion factor will not changed, and the conversion factor may not be calibrated when the soft system for measuring the laser beam point is used in the further.

The principle of the coordinate conversion is as followings:

The left corner is selected as the zero-point of the screen coordinate system, the positive direction of X axial is right and Y axial is down. We can project two laser beam points A($x1$, $y1$), B($x2$, $y2$) on the screen ($x1$, $y1$, $x2$, $y2$ are the prescribed screen coordinate), and let the $x1 \neq x2$, $y1 \neq y2$. The pixel coordinate value ($x1$,$y1$) on the picture shot by video camera of point A can be calculated by comparing the grey values (the coordinate system of the picture shot by video camera selects the left corner as the zero-point and the positive direction of X axial is right and Y axial is down. Just as the same we can obtain the pixel coordinate ($x2$, $y2$) of the B in the picture of video camera, and the coordinate value (H,K) in the screen coordinate system of the coordinate zero-point of the shot picture by the video camera by principle of geometrical conversion. Then the coordinate value (x, y) in the screen coordinate system can be calculated with the formula $x=X+H$, $y=Y+K$.

Figure 2:
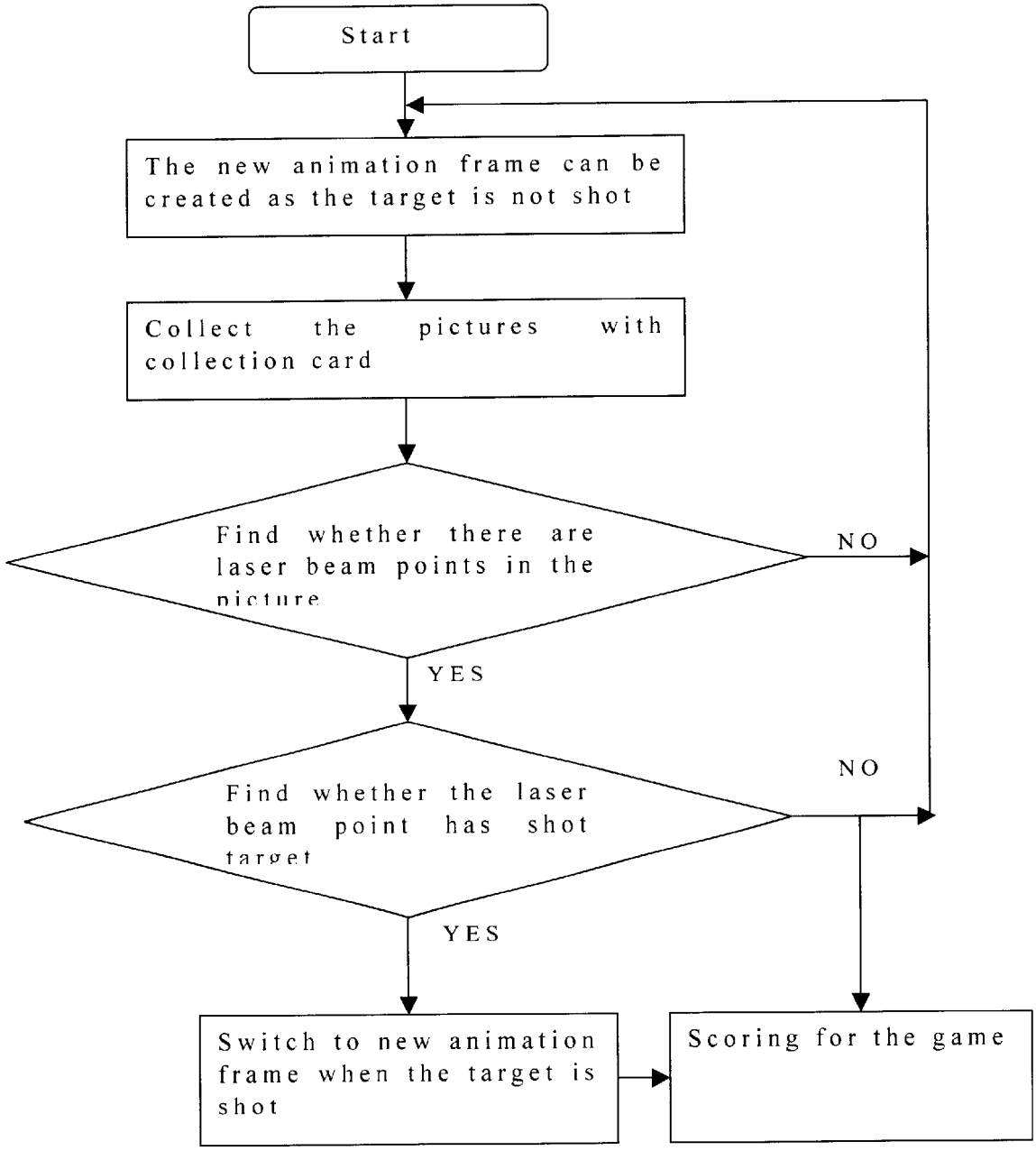
FIG. 2 is the program flow chart of the soft system of master control.

The soft system for the master control will perform the flow chart shown in FIG. 2:

The new animation frame can be created firstly when the target is not shot, and then collect the figure signals processed by the soft system for measuring the laser beam point, determine whether there are laser beam points in the figure (yes/no), if no, then return to the new animation frame when the above created targets are not shot, if yes, then determine whether the target has been shot by the laser, if no, return to the new animation frame again when the above created targets are not shot and score the game, if yes, then switch to the new animation frame when the targets are shot and score the game.

It should be noted that under the preconditions of not losing contact with reality, the ordinary technician can modify or remodel this electronic device, all the relevant modifications or remodels are considered under the protection scope of this invention.

What is claimed is:

1. A simulated laser shooting system which includes a laser gun and a target, said simulated laser shooting system comprising:

a) a monitor for showing the target;

b) a video camera;

c) a collecting card wherein an outlet of said video camera is in communication with an inlet of said collecting card;

d) a sound apparatus; and e) a master computer including:

i) a software system for measuring a laser beam point wherein said software system controls said collecting card and said video camera and is in communication with said output of said collecting card; and ii) a software system for a master control for controlling said sound apparatus and said monitor;

wherein said video camera is disposed in a place where said camera can shoot said high definition pictures and wherein said software system for master control can perform the following steps:

generating a new animation frame when the target is not shot;

collecting a plurality of picture signals processed by said software system for measuring said laser beam point;

detecting whether there are laser beam points in said picture;

returning to a new animation frame if said laser beam is not pointing at said picture;

detecting whether said laser beam point has shot the target;

returning to said step of generating to a new animation frame if the target is not shot;

scoring said game if the target is not shot;

switching to a new animation target if the target is shot; and scoring said game when the target is shot.

2. A feature of the simulated laser shooting system of claim 1, wherein said master computer can be connected with other simulated laser shooting systems by the Internet.

* * * * *

UNITED STATES PATENT AND TRADEMARK OFFICE

CERTIFICATE OF CORRECTION

PATENT NO. : 6,551,189 B1
DATED : April 22, 2003
INVENTOR(S) : Chen et al.

It is certified that error appears in the above-identified patent and that said Letters Patent is hereby corrected as shown below:

Title page,
Item [30], Foreign Application Priority Data correctly should read:

-- Dec. 3, 1999 (CN) …….. 99125554.2 --.

Signed and Sealed this

Sixteenth Day of September, 2003

JAMES E. ROGAN
*Director of the United States Patent and Trademark Office*